US006182938B1

(12) United States Patent
Wright

(10) Patent No.: US 6,182,938 B1
(45) Date of Patent: Feb. 6, 2001

(54) PUSH BUTTON APPARATUS FOR WALL HANGINGS AND CALENDARS

(76) Inventor: Guy B. Wright, 3916 Calle Cita, Santa Barbara, CA (US) 93110-1520

( * ) Notice: Under 35 U.S.C. 154(b), the term of this patent shall be extended for 0 days.

(21) Appl. No.: 09/098,109

(22) Filed: Jun. 16, 1998

Related U.S. Application Data

(60) Provisional application No. 60/057,040, filed on Aug. 19, 1997.

(51) Int. Cl.[7] ..... G09F 7/18; A47G 1/16

(52) U.S. Cl. ..... 248/468; 248/316.4; 211/45; 40/617

(58) Field of Search ..... 248/468, 491, 248/489, 475.1, 316.1, 316.4, 316.6; 211/45, 89.01; 24/469, 535, 243; 40/107, 904; 40/617

(56) References Cited

U.S. PATENT DOCUMENTS

| | | | | |
|---|---|---|---|---|
| 275,602 | | 4/1883 | David | 402/69 |
| 411,061 | | 9/1889 | Robinson | 283/2 |
| 535,401 | | 3/1895 | Reed | 402/24 |
| 605,492 | | 6/1898 | Lavender | 402/28 |
| 721,424 | | 2/1903 | Clark | 211/59.1 |
| 843,363 | | 2/1907 | Priddy | 211/57.1 |
| 858,115 | | 6/1907 | Stebbings | 402/69 |
| 960,886 | | 6/1910 | Galli | 211/57.1 |
| 1,291,001 | | 1/1919 | Horwitz | 211/57.1 |
| 1,442,620 | | 1/1923 | Landon | 402/69 |
| 1,700,641 | | 1/1929 | Medlock | 211/57.1 |
| 2,622,300 | * | 12/1952 | Marziani | 24/501 |
| 2,626,816 | | 1/1953 | Winford | 283/2 |
| 2,973,099 | * | 2/1961 | Sova | 248/316.4 |
| 3,039,728 | * | 6/1962 | Sova | 248/316.4 |
| 3,963,208 | * | 6/1976 | Sova | 248/316.4 |
| 4,085,848 | * | 4/1978 | Tsuge | 211/45 |
| 4,128,224 | * | 12/1978 | Guichard | 248/316.4 |
| 4,411,544 | | 10/1983 | Gallman | 402/69 |
| 4,629,075 | * | 12/1986 | Hutten | 211/89.01 |
| 5,593,192 | | 1/1997 | Stuchinsky | 292/207 |

* cited by examiner

*Primary Examiner*—Anita M. King
(74) *Attorney, Agent, or Firm*—Kenneth J. Hovet

(57) ABSTRACT

A housing is provided which attaches to a wall and includes mechanisms for releasable attachment to a wall hanging such as a calendar. The housing may have a decorative facade and includes a depressible button which operates through a spring biased J-shaped rod or flexible strips to move a clasp member out of an elongated slot in the bottom of the housing. The slot accommodates an edge portion of a wall hanging. Securement occurs when the button is released and the spring bias or inherent flexibility of the strip member frictionally engage the wall hanging edge. Alternatively, the wall hanging edge may include an engagement aperture. In such case, the clasp member will pass through the aperture and suspend the wall hanging in the housing slot.

11 Claims, 7 Drawing Sheets

PUSH BUTTON APPARATUS FOR WALL HANGINGS AND CALENDARS

This application claims priority from Provisional Application Serial No. 60/057,040 filed Aug. 19, 1997.

BACKGROUND OF THE INVENTION

1. Field of the Invention

The invention pertains to an apparatus for releasably attaching wall hangings to a vertical structure.

2. Description of the Prior Art

Wall hangings such as calendars are typically mounted to walls through primitive attachment devices, which include driving nails or pins through the wall hanging and into the wall. Adhesive means such as glue are also used. However, the aforementioned attachment devices present several disadvantages. Foremost, nailing or gluing hangings into walls creates unwanted damage, including holes and stains on the wall hanging and wall.

Hanging calendars create a particular problem because they typically contain multiple pages, where each page represents one month or other time period. In order to access all the pages, the user must repeatedly remove and reattach the calendar to the wall. Such actions may result in wall damage. Moreover, use of the prior art attachment devices can become cumbersome and tedious, requiring the user to repeatedly pin and remove the calendar.

SUMMARY OF THE INVENTION

The present invention relates to an improved apparatus for attaching wall hangings and calendars to a wall or other vertical structure. As used herein, the term "wall hanging" is intended to encompass all types of articles typically hung from a vertical support structure including artwork, shades, posters, charts, calendars, textile materials, decorative articles, lighting devices, and ornate panels. Specifically, the apparatus is attached to a wall, where it selectively engages a wall hanging, thereby removing the need to directly attach the wall hanging through primitive attachment means.

Principal elements of the invention comprise a housing having a wall attachment means, a slot in the housing for receiving a predetermined part of the wall hanging and a clasp means for holding the wall hanging in the slot. The housing may be decorative in appearance with a front and rear facade.

In the preferred embodiments, the slot extends along a bottom end of the housing. The slot has sufficient width to accommodate the thickness of a wall hanging part such as the upper end of a multi-page calendar. The clasp means includes a clasp member that will releasably engage the wall hanging. If the wall hanging is provided with an engagement aperture, the clasp member will pass through the aperture for a more secure connection.

The clasp means includes an activating button accessible from the front facade. The button is connected to an actuating means for moving the clasp member across the slot.

The invention encompasses four embodiments of the clasp means. A first embodiment utilizes a J-shaped rod as an actuating means. A top segment of the rod is fixed to the button which extends through a button recess in the front facade. From the recess, the top segment passes through the rear facade and then turns about 90 degrees to a mid-segment. The mid-segment merges into a second turn from which extends a bottom segment comprising the aforementioned clasp member. A biasing means may be inserted between the button and button recess to maintain the clasp member in a closed position in the slot.

A second embodiment provides a flexible E-strip as the actuating means. The top end of the strip is fixed to the housing rear facade. Proximate the strip midpoint is a connector element comprising a button attachment part which extends into the housing and engages the button. The lower portion of the strip is provided with the aforementioned clasp member comprising an outwardly directed clasp part. When the button is depressed, the clasp part will withdraw from the housing slot. Upon release of the button, the inherent flexural strength of the E-strip will move the clasp part back into the slot.

A third embodiment of the actuating means comprises an L-shaped flex member. The upper end of the flex member is secured to the rear facade. The lower end is provided with the clasp member comprising a clasp element. In its normal position, the clasp member extends outwardly across the aforementioned slot. A connector element comprising a button fastener interconnects the flex member to the button. Alternatively, the element may extend inwardly from the button and simply abut the inner surface of the flex member. Either way, depressing the button will cause deflection of the flex member and move the clasp element out of the slot.

The fourth embodiment utilizes a housing comprising front and rear interlocking shell parts. The actuating means comprises a flexible panel extending from the rear shell having a button connector element which secures the panel to the button. The panel also includes a clasp member comprising a clasp projection extending outwardly from the panel free end portion. When the panel is in its normal position, the projection extends into the housing slot to permit operation in a manner similar to the above embodiments.

DESCRIPTION OF THE PREFERRED EMBODIMENTS

Embodiment I

Figure 1:
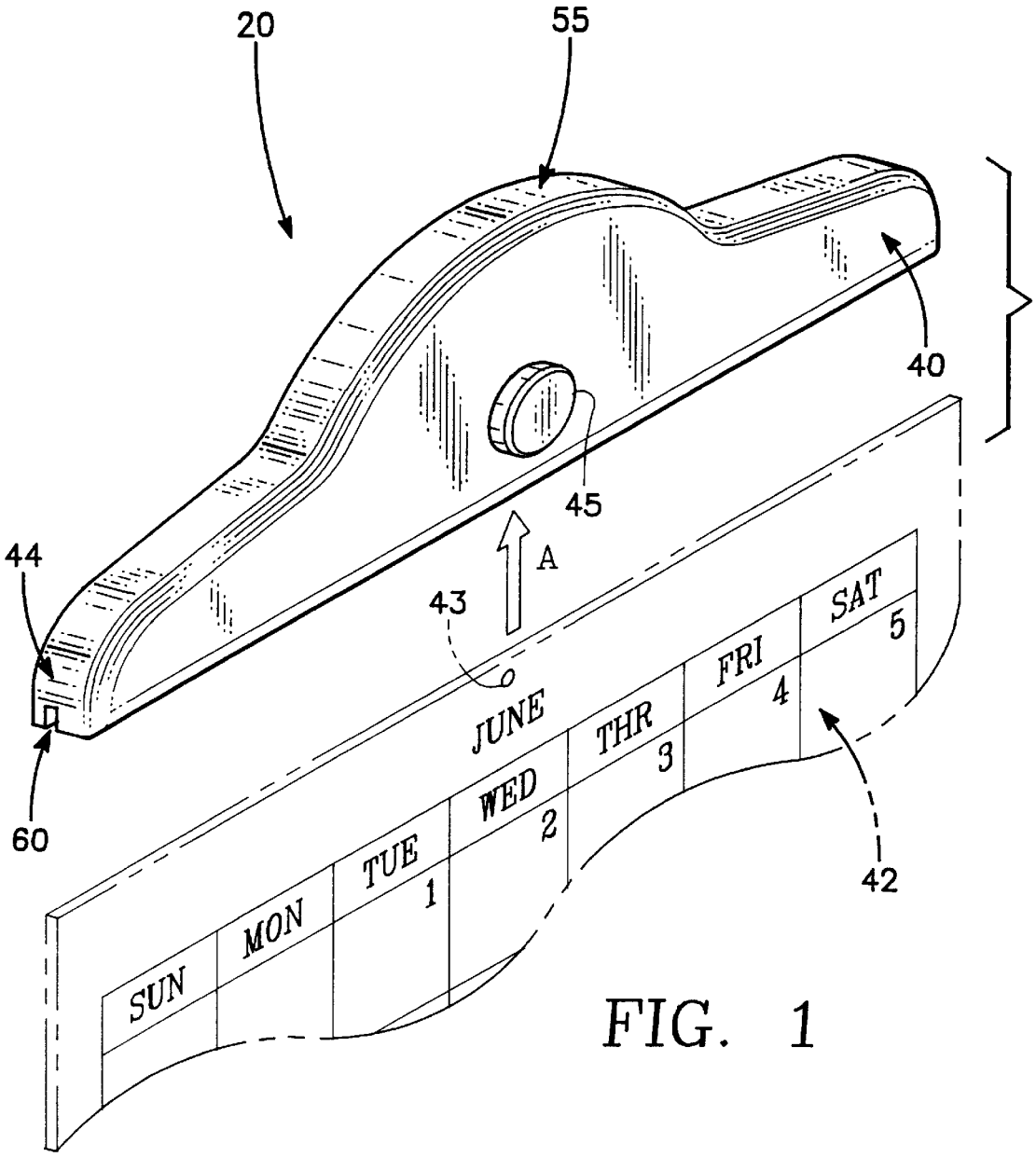
FIG. 1 is an exploded front perspective showing a front facade common to all embodiments of the invention.
Figure 2:
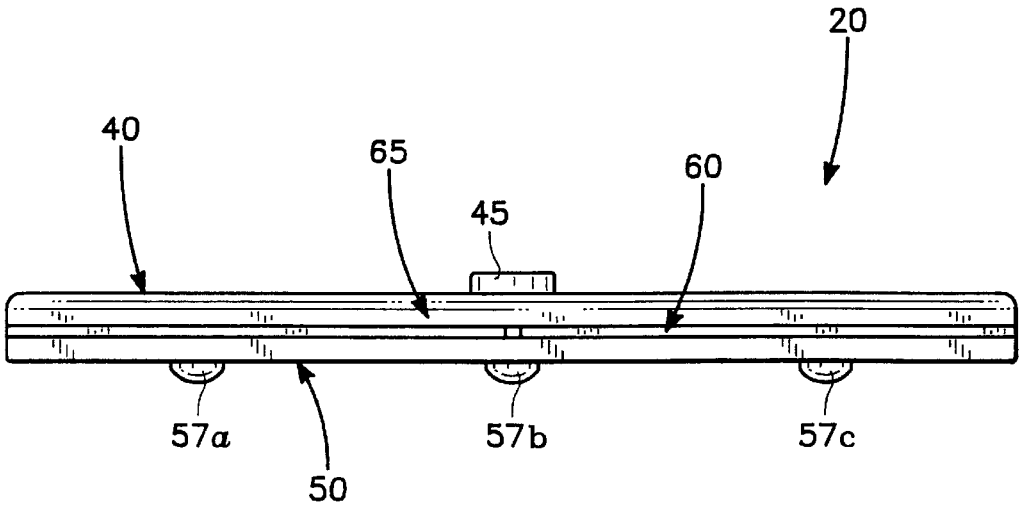
FIG. 2 is a bottom plan view of FIG. 1 that is common to all embodiments of the invention.
Figure 3:
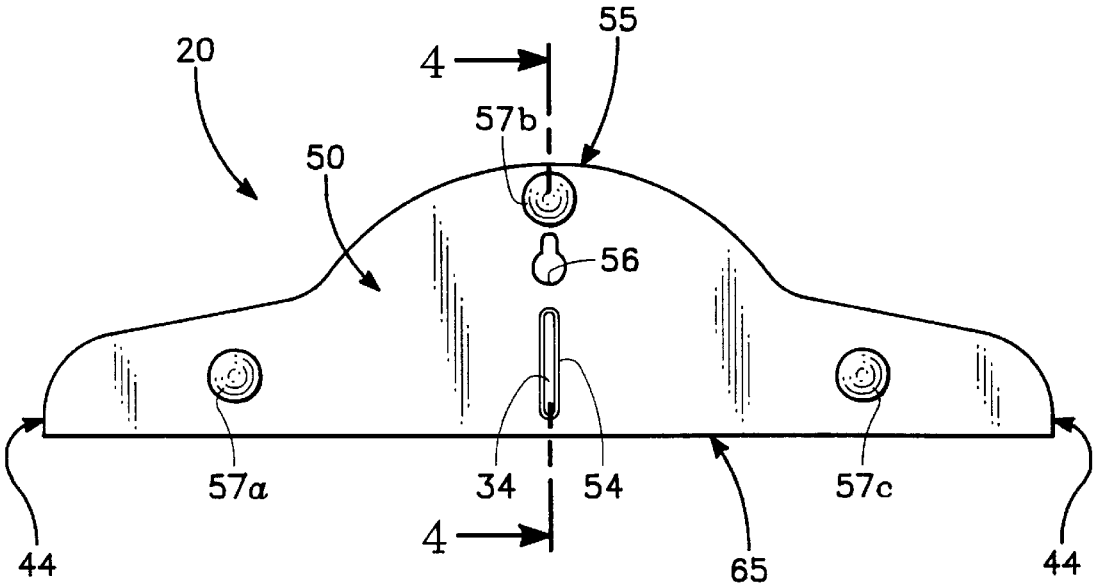
FIG. 3 is a rear elevational view of a first embodiment of the invention.

With reference now to the drawings, FIGS. 1 through 5 show a housing 20 comprising an elongated solid body of predetermined thickness. It is defined by a front facade 40 and a rear facade 50 which are outlined by a top end 55. The top end merges into opposing side walls 44 which extend to a bottom end 65. The bottom end 65 is preferably straight and includes a slot 60 proximate its mid-line. Preferably, the slot extends along the entire longitudinal extent of the bottom end.

The slot interior comprises a planar slot front side 61 and a rear side 62. The sides are parallel to their respective facades and to each other. The slot has sufficient width and depth to accommodate insertion of the top end portion of at least a multi-page calendar as depicted by reference 42 in FIG. 1. Although not mandatory, the midpoint of the aforementioned top end portion includes an engagement aperture 43 extending therethrough.

In the lower mid-portion of the front facade is a button opening 22. The opening has a diameter and depth that is sufficient to permit in and out movement of an activating means shown as button 45. The depth should also be sufficient to contain a biasing means shown as spring 26.

The button and its corresponding opening preferably have a circular cross-sectional shape. However, other round or polygonal shapes could be used. The underside 47 of the button is preferably flat and includes a fastener opening 48 for a purpose to be hereinafter described.

As shown in FIGS. 3–11, the rear facade 50 is provided with an undercut opening 56 for engaging a hook or nail extending from a support structure such as a wall. Additionally, wall spacers 57*a*, 57*b* and 57*c* on the rear facade 50 spatially buffer the housing from the wall.

In the first embodiment, the clasp means comprises a solid rod 30 of metal or plastic. The rod is bent into a J-shape and includes three integrated segments comprising a top segment 32, middle segment 34 and bottom segment 36. The bottom segment constitutes the aforementioned clasp member.

The top segment threadably engages fastener opening 48 extending into the underside 47 of the button. It passes through button opening 22 and through housing upper aperture 38 to a first corner proximate the rear facade. The portion of the top segment passing through opening 22 is circumscribed by a spring part shown as coil spring 26, which is positioned within the opening to outwardly bias the button 45.

At the first corner, the top segment turns about 90 degrees and merges into a middle segment 34. The middle segment 34 is located within a narrow rod recess 54 that extends along the rear facade to a housing lower aperture 24. The lower aperture 24 accesses housing slot 60 through the slot rear side 62.

Figure 4:
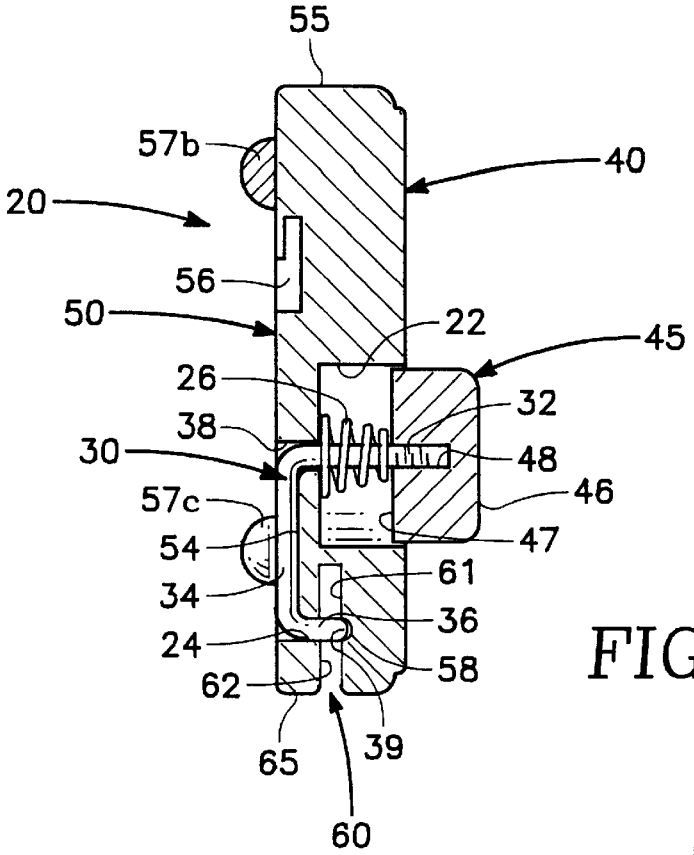
FIG. 4 is a cross-sectional view taken along lines 4—4 of FIG. 3 showing the clasp means in a closed position.

The middle segment of the rod extends to a second corner where it turns about 90 degrees and merges into the bottom segment 36. The bottom segment extends inwardly through housing lower aperture 24 and across slot 60. It terminates at free end 39. When the assembly is in a closed position as shown in FIG. 4, free end 39 will rest within divot 58 on slot front-side 61.

To move the bottom segment 36 out of slot 60 to an open position, button 45 is depressed into recess 22. This action moves middle segment 34 out of the rod recess 54. Simultaneously, the bottom segment retreats from slot 60 into the housing lower aperture 24, thereby clearing the slot of obstruction.

Figure 5:
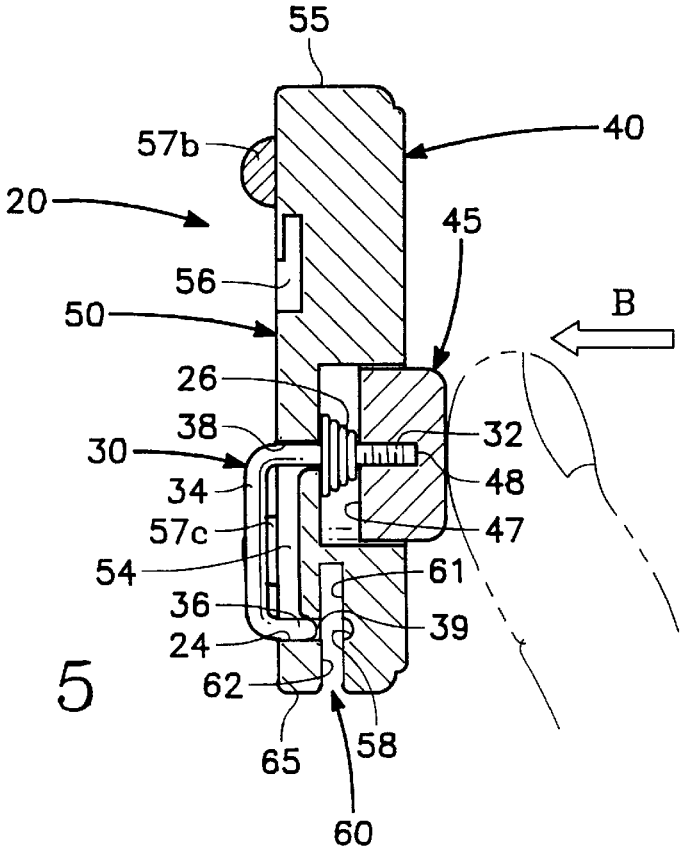
FIG. 5 is a cross-sectional view similar to FIG. 4 showing the clasp means in an open position.

While holding the button in a depressed position within opening 22, as depicted in FIG. 5 and Arrow B, calendar 42 is inserted into slot 60 as shown by Arrow A in FIG. 1. The calendar or other wall hanging is positioned in a balanced manner a sufficient distance into the slot to permit a firm frictional engagement with free end 39 when the button is released.

When the wall hanging or calendar include a centrally located engagement aperture, such as that shown by reference 43 in FIG. 1, alignment is facilitated by placing the aperture over divot 58 and releasing button 45. Upon release, spring 26 will return rod 30 to its original position such that free end 39 will pass through the hanging aperture and engage divot 58. In this closed position, the calendar will hang from bottom segment 30.

Embodiment II

Figure 6:
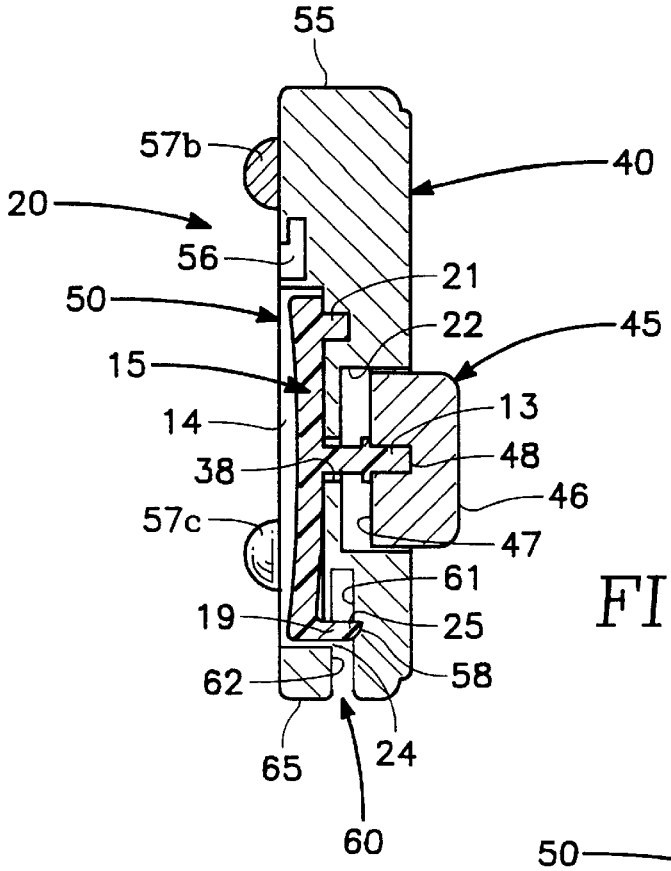
FIG. 6 is a cross-sectional view showing the clasp means of a second embodiment in a closed position.
Figure 8:
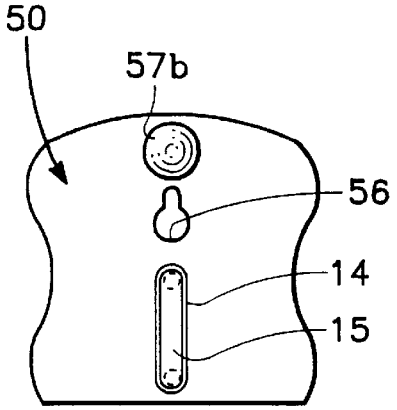
FIG. 8 is a fragmentary rear elevational view of the second embodiment shown in FIG. 6.
Figure 7:
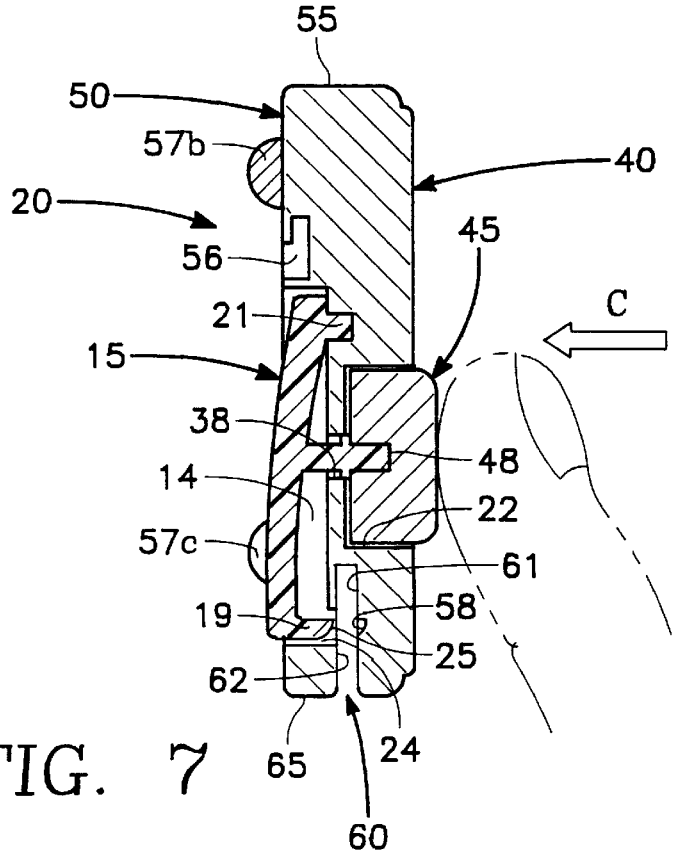
FIG. 7 is a cross-sectional view similar to FIG. 6 showing the clasp means in an open position.

With reference to FIGS. 6–8, a second embodiment is shown comprising elements similar to those contained in the first embodiment. Therefore, these elements will be designated by the same reference numerals in this embodiment.

The second embodiment employs a solid body housing 20 defined by front and rear facades 40,50 with a top end 55, bottom end 65 and side walls 44. Likewise, slot 60 extends along bottom end 65 with the slot front-side 61 and rear-side 62 parallel to the respective facades.

Button 45 reciprocates within button opening 22, which is located in the lower mid-portion of the front facade 40. The flat underside 47 of the button includes fastener opening 48 that engages a button fastener 13 in a manner described below.

The mid-portion of rear facade 50 includes a strip recess 14. Within the recess is located an elongated flexible E strip 15. The upper portion of the strip is fixed to the housing by a first outwardly extending projection 21. The projection extends into a corresponding opening in the housing and is secured thereto by threads, adhesive, frictional engagement or other means known in the art.

The aforementioned button fastener 13 extends outwardly from a midpoint of the E strip and through housing upper aperture 38. From the upper aperture, it extends into fastener opening 48 and is secured thereto in the same manner as described in relation to first projection 21.

Extending outwardly from the bottom end of the E strip is clasp part 19. The clasp part terminates at distal end 25. As shown in FIG. 6, when button 45 is in its released position, the clasp part extends through the housing lower aperture 24 and across slot 60. Distal end 25 rests against divot 58 on the slot front-side 61.

Pressing button 45 as shown by Arrow C in FIG. 7, deflects the E strip outwardly and causes clasp part 19 to retreat from the slot into lower aperture 24. In this open portion, engagement with a wall hanging may take place in the same manner as described in relation to the first embodiment. Upon release of the button, inherent flexibility of the E strip will move the clasp part back into the slot until distal end 25 rests against divot 58.

Embodiment III

Figure 9:
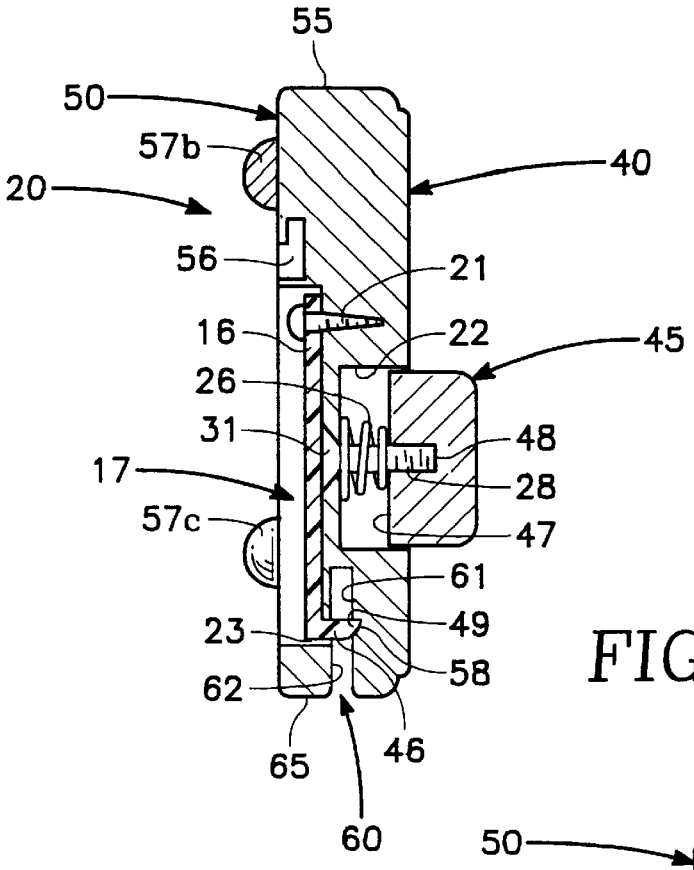
FIG. 9 is a cross-sectional view showing the clasp means of a third embodiment in a closed position.
Figure 11:
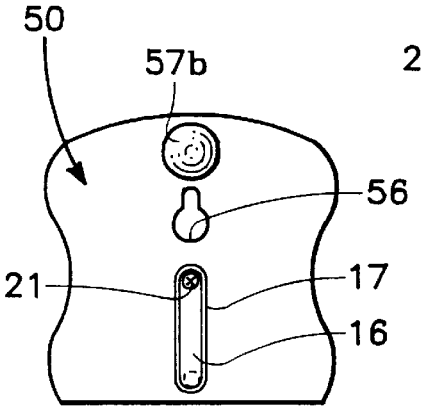
FIG. 11 is a fragmentary rear elevational view of the third embodiment shown in FIG. 9.
Figure 10:
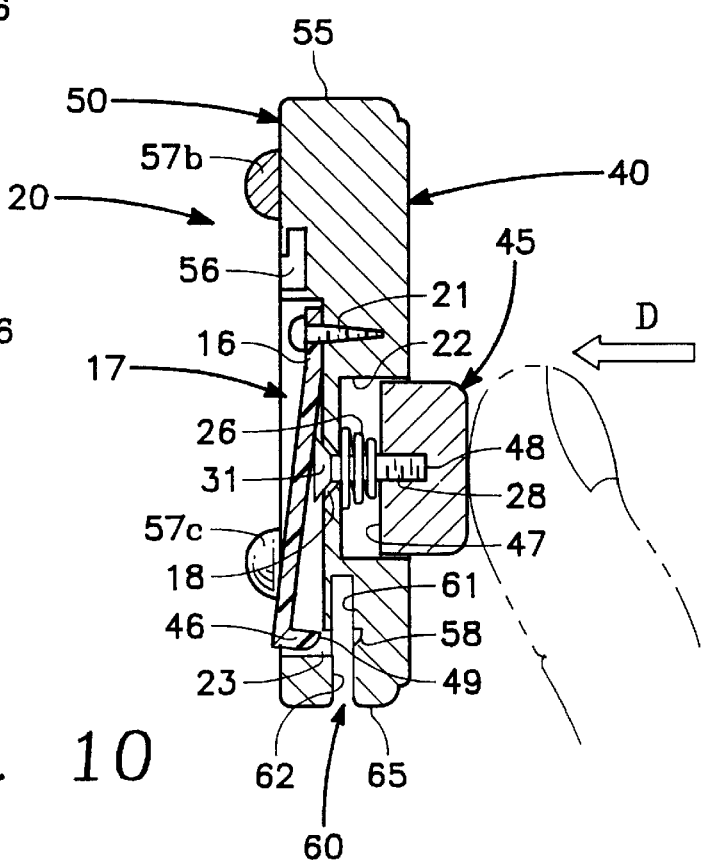
FIG. 10 is a cross-sectional view similar to FIG. 9 showing the clasp means in an open position.

With reference to FIGS. 9–11, a third embodiment is shown comprising elements similar to the aforementioned embodiments. Therefore, elements equivalent to those in the first and second embodiments are designated by the same reference numerals.

Housing 20 of the third embodiment is basically the same as the second embodiment housing. Proximate the mid-portion of rear facade 50 is a flex member recess 17. Secured within the recess is an L-shaped flex member 16. A strip fastener 21' secures the upper end of the flex member to the housing within the recess.

In about the mid-area of recess 17 is a countersunk aperture 18. The aperture extends from the recess into button recess 22. An abutment part 28 extends through the countersunk aperture and passes through biasing spring 26. It extends into fastener opening 48 and becomes fixed to the button by threads, adhesives or frictional engagement means known in the art. As shown, the abutment part is provided with an enlarged head 31 that contacts the underside of flex member 16.

The lowermost end of the flex member is provided with an inwardly directed clasp element 46. When the flex member is straight and unstressed as shown in FIG. 9, the clasp element extends through a clasp opening 23 in the housing and across slot 60 to a terminal end 49 at divot 58.

When button 45 is pushed as shown by Arrow D in FIG. 10, enlarged head 31 moves flex member 16 against the bias of spring 26 and causes the clasp element 46 to withdraw from the slot. Thereafter, wall hangings may be inserted into the slot and become releasably connected in the manner described in the previous embodiments.

Embodiment IV

With reference to FIGS. 12–16, a fourth embodiment is shown comprising elements similar to those contained in the aforementioned embodiments. Therefore, such elements are designated by the same reference numerals in this embodiment.

The fourth embodiment utilizes a two-part housing comprising a front shell 70 and a rear shell 80. The shells preferably comprise thin-walled molded structures which are interconnected by a peripheral engagement means in a manner described below.

The front shell is defined by an exterior front face 75, a front interior surface 72, a top end 73, opposing side walls 67 and a bottom end 74. Extending along the upper periphery is an upper rib 102. The rib comprises part of the engagement means for locking the shells together.

In the lower mid-portion of the front shell is an inwardly directed boss structure 78. The boss structure is defined by an inwardly facing abutment wall 79 from which extend three orthogonal polygonal-shaped peripheral wall panels 76. The panels extend inwardly from interior surface 72 and create a box-like chamber comprising button recess 22. To provide access to the button recess, abutment wall 79 includes a central orifice 68.

The bottom of the boss structure comprises the upper end of the lower base section 95. The bottom of the abutment wall 79 comprises bottom ledge 77. As so disposed, the bottom ledge becomes part of the engagement means that extends outwardly from the inner face 96 of the lower base section 95.

The rear shell 80 is defined by a rear interior surface 81, a rear face 82, a top shell wall 83 and a bottom shell wall 84. In use, the rear shell will be oriented so that the rear face is adjacent a vertical wall structure and the rear interior surface will face the front interior surface 72 of the front shell.

The upper area of rear shell wall 101 includes an attachment opening 103 for engaging a wall hanger means such as a nail or hook. The lower shell wall area is provided with a flex opening 104. The flex opening is coextensive with the boss structure when the front and rear shells are engaged. It extends from offset wall 105 to bottom shell wall 84.

Extending inwardly and downwardly from the upper area of the shell wall into the flex opening is panel 85. As shown, the panel is integral with the rear shell wall and is constructed of a flexible material such as plastic, metal or fiberglass composites. It extends to a free end portion 87 which is slightly spaced above the bottom shell wall 84.

Extending inwardly from the mid-region of the panel is button attachment part 90. This part passes through central orifice 68 and into fastener opening 48 where it is fixed to button 45 when the front and rear shells are assembled.

Figures 12, 13, 14:
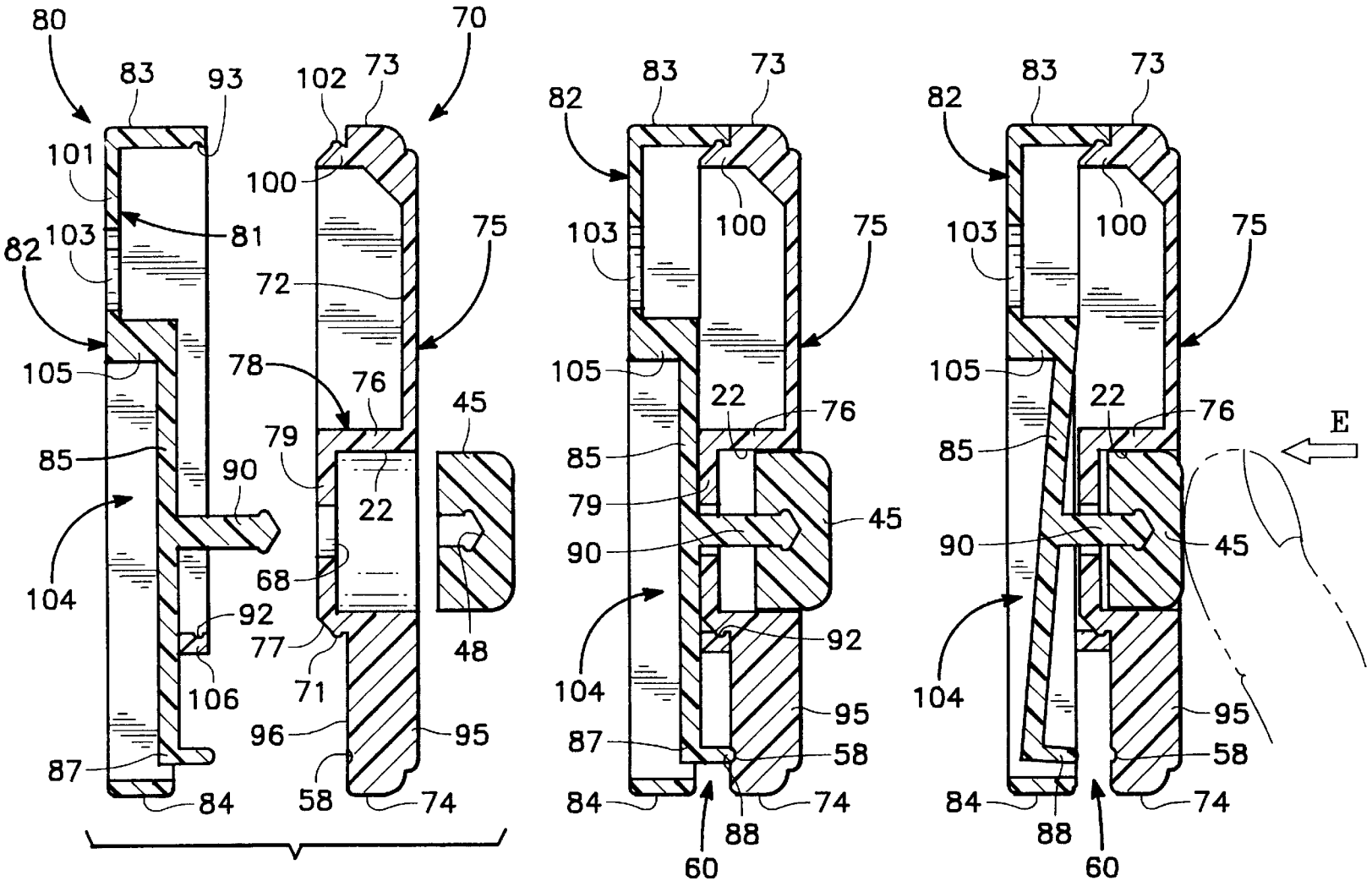
FIG. 12 is an exploded cross-sectional view showing the clasp means of a fourth embodiment with a two-part housing.
FIG. 13 is a cross-sectional view of the fourth embodiment showing the housing parts assembled and the clasp means in a closed position.
FIG. 14 is a cross-sectional view similar to FIG. 13 showing the clasp means in an open position.
Figure 15:
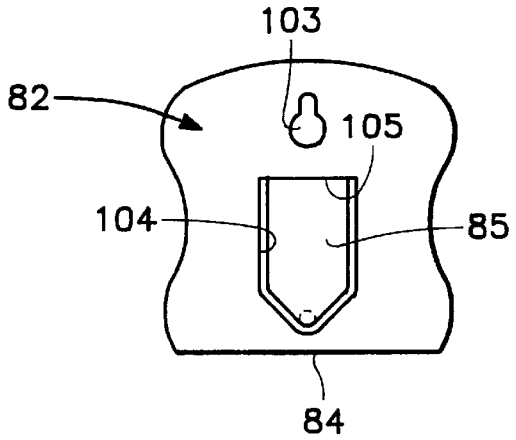
FIG. 15 is a fragmentary rear elevational view of the housing shown in FIG. 12.
Figure 16:
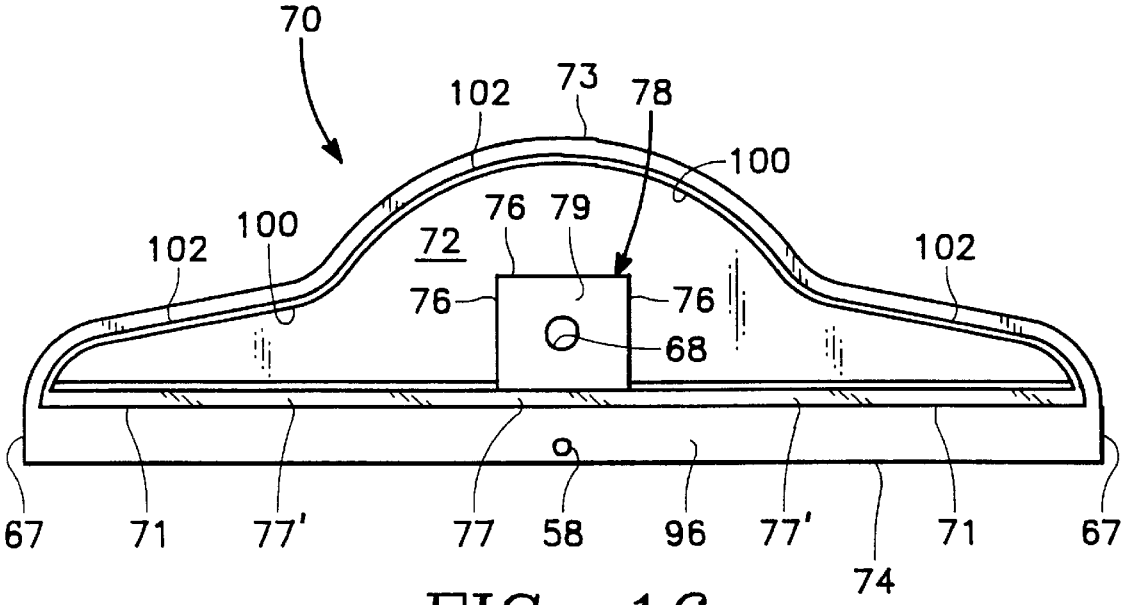
FIG. 16 is an elevational view of the interior of the front part of the housing shown in FIG. 12.

From the free end portion 87 extends clasp projection 88. The projection has sufficient length to engage divot 58 at inner face 96 when the shells are assembled and the clasp means is in a closed position as shown in FIG. 13.

The boss structure and corresponding shell walls have sufficient depth to provide the requisite separation when the shell parts are assembled for creating the slot area 60. Therefore, when a user depresses button 45 as depicted by Arrow E in FIG. 14, the panel will swing rearward causing retraction of the clasp projection 88 into the lower area of the flex opening 104. In this manner, connection and release of a wall hanging will occur in the same manner as described in the previous embodiments.

The engagement means for the housing comprises two sets of engagement structures. The first set comprises an upper rib 102 on an offset lip extension 100 of the front shell upper periphery. The upper rib engages a coextensive top groove 93 on the inner edge of shell wall 83.

The second set comprises opposing longitudinal ridge structures 77' which merge coextensively into opposing ends of bottom ledge 77. The ledge and ridge structures include a rib 71. The rear shell interior surface 81 has a shoulder structure 106 that extends coextensively with the aforementioned bottom ledge and ridge. The shoulder includes a shoulder groove 92 which corresponds with the ledge rib 71. Therefore, when the above matching shell engagement structures are pressed together, a secure frictional engagement will occur. It will also be appreciated that the shell parts may be secured together in other ways known in the art. Examples are sonic or chemical bonding, adhesives, welding and mechanical fasteners.

While the invention has been described with respect to a preferred embodiment, it will be apparent to those skilled in the art that various modifications and improvements may be made without departing from the spirit and scope of the invention. Accordingly, it is to be understood that the invention is not to be limited by the specific illustrative embodiments, but only by the scope of the appended claims.

I claim:

1. An apparatus for holding wall hangings comprising:

a housing having a front facade and having a slot for receiving a predetermined part of a wall hanging;

a clasp means in said housing for releasably engaging said predetermined part in said slot, said clasp means including an activating button accessible from said front facade and including a clasp member that extends into said slot for releasable engagement with said wall hanging part;

said clasp means also including an actuating means for moving said clasp member in response to movement of said activating button; and said actuating means being selected from the group consisting of a J-shaped rod, a flexible E-strip, an L-shaped flex member and a flexible panel.

2. The apparatus of claim 1 wherein said actuating means includes a biasing means for maintaining said clasp member in said slot.

3. The apparatus of claim 2 wherein said actuating means comprises said J-shaped rod and said biasing means comprises a spring part.

4. The apparatus of claim 3 wherein said front facade includes a button recess within which reciprocates said activating button.

5. The apparatus of claim 4 wherein said spring part is positioned in said button recess.

6. A housing for releasably holding a wall hanging, said housing having a front facade with a button recess and a back facade circumscribed by a top end which merges into opposing side walls and a bottom end, a slot in said housing for receiving a predetermined part of a wall hanging and a clasp means connected to said housing for releasably engaging said predetermined part;

said housing including a wall attachment means for securement to a wall or other vertical structure;

said clasp means including an activating button which is interconnected to a clasp member whereby selected movements of said activating button causes movement of said clasp member into said slot to a closed position and out of said slot to an open position, said button extending into said button recess;

said activating button and clasp member being interconnected by an actuating means; and, said actuating means including a biasing means for maintaining said clasp member in a normally closed position.

7. The housing of claim 6 wherein said activating button is accessible from said front facade and said wall attachment means is located on said back facade.

8. The housing of claim 6 wherein said biasing means includes a spring part in said button recess.

9. The housing of claim 6 wherein said actuating means is selected from the group consisting of a J-shaped rod, a flexible E-strip, an L-shaped flex member and a flexible panel.

10. The housing of claim 9 wherein said clasp member extends from an end portion of said J-shaped rod, flexible E-strip, L-shaped flex member and flexible panel.

11. The housing of claim 10 wherein said J-shaped rod has a top segment connected to said activating button and said flexible E-strip, L-shaped flex member and flexible panel each have a connector element for engaging said activating button.

* * * * *